US008073782B2

(12) United States Patent
Dillard et al.

(10) Patent No.: US 8,073,782 B2
(45) Date of Patent: Dec. 6, 2011

(54) ADVANCED CRYPTO ROUND DATER

(75) Inventors: Leon Nathaniel Dillard, Woodbridge, VA (US); Wayne Alan Wilkerson, Manassas, VA (US); Roy Roger Gordon, Gaithersburg, MD (US)

(73) Assignee: United States Postal Service, Washington, DC (US)

( * ) Notice: Subject to any disclaimer, the term of this patent is extended or adjusted under 35 U.S.C. 154(b) by 976 days.

(21) Appl. No.: 10/746,099

(22) Filed: Dec. 23, 2003

(65) Prior Publication Data

US 2004/0153425 A1 Aug. 5, 2004

Related U.S. Application Data

(60) Provisional application No. 60/436,509, filed on Dec. 23, 2002.

(51) Int. Cl.
*G06Q 99/00* (2006.01)

(52) U.S. Cl. ..... 705/62; 705/1; 705/50; 705/63; 705/401; 705/408; 705/409; 705/410; 713/150

(58) Field of Classification Search ..... 705/50–79, 705/401–411, 1; 713/150
See application file for complete search history.

(56) References Cited

U.S. PATENT DOCUMENTS

| | | | | |
|---|---|---|---|---|
| 4,874,936 | A | 10/1989 | Chandler et al. | |
| 5,301,116 | A * | 4/1994 | Grunig | 705/410 |
| 5,513,264 | A | 4/1996 | Wang et al. | |
| 5,612,889 | A | 3/1997 | Pintsov et al. | |
| 5,781,438 | A | 7/1998 | Lee et al. | |
| 5,959,283 | A | 9/1999 | Tawara et al. | |
| 6,088,482 | A | 7/2000 | He et al. | |
| 6,141,441 | A | 10/2000 | Cass et al. | |
| 6,244,763 | B1 | 6/2001 | Miller | |
| 6,428,219 | B1 | 8/2002 | Stier et al. | |
| 6,461,063 | B1 | 10/2002 | Miller et al. | |
| 6,463,354 | B1 | 10/2002 | Pintsov | |
| 2002/0083022 | A1 * | 6/2002 | Algazi | 705/408 |
| 2002/0110397 | A1 * | 8/2002 | Bussell | 400/104 |
| 2002/0127040 | A1 * | 9/2002 | Davies et al. | 400/76 |
| 2003/0088426 | A1 * | 5/2003 | Benson et al. | 705/1 |
| 2003/0101143 | A1 * | 5/2003 | Montgomery et al. | 705/62 |
| 2004/0093314 | A1 * | 5/2004 | MacKlin | 705/406 |
| 2005/0209976 | A1 * | 9/2005 | Bailey et al. | 705/402 |

FOREIGN PATENT DOCUMENTS

| | | | |
|---|---|---|---|
| GB | 2174039 | * | 10/1986 |
| GB | 2271452 A | * | 9/1993 |
| WO | 2004/059483 A1 | | 7/2004 |

OTHER PUBLICATIONS

Automatic Data Capture, EDIFICE Bar Code Group, Apr. 2000.

(Continued)

*Primary Examiner* — Jalatee Worjloh
(74) *Attorney, Agent, or Firm* — Lewis and Roca LLP

(57) ABSTRACT

There is provided a cryptographic round dater and its method of use. By capturing customer profile information and encoding the information on a label affixed to the customer's submitted mailpiece, fraudulent or criminal use of the mail may be deterred by providing traceability to the source of the mail piece. The information attached to the mailpiece may be both human readable and machine readable, said machine readable portion being optionally encrypted to protect the privacy and security of the encoded information. Further benefit is provided by allowing the handling of a mailpiece to be traced, allowing for effective remediation or investigation in the event of an unauthorized use of mail.

8 Claims, 4 Drawing Sheets

OTHER PUBLICATIONS

Author: United States Postal Service, "Performance Criteria for Information-Based Indicia and Security Architecture for Open IBI Postage Metering Systems," Apr. 26, 1999.

"Cryptographic Module Security Policy for the Ascom Hasler Mailing Systems, Inc.; " Ascom Hasler Mailing Systems, Jun. 20, 2001, pp. 3-9.

Ham, L., "Two Internet B2C Services: e-Stamp and e-Ticket, Proc. of the 11th National Conference on Information Security," May 3, 2001, pp. 271-280, Tainan, Taiwan.

Author: United States Postal Service, "Performance Criteria for Information-Based Indicia and Security Architecture for Open IbI Postage Metering Systems," Feb. 23, 2000.

* cited by examiner

ADVANCED CRYPTO ROUND DATER

CROSS REFERENCES TO RELATED APPLICATIONS

This application claims the full benefit and priority of U.S. Provisional Application Ser. No. 60/436,509, filed on Dec. 23, 2002, the disclosure of which is fully incorporated herein for all purposes.

STATEMENT REGARDING FEDERALLY SPONSORED RESEARCH OR DEVELOPMENT

The invention was made by an agency of the United States government or under a contract with an agency of the United States government, the United States Postal Service ("USPS" or "Postal Service"), an independent establishment of the executive branch of the U.S. government.

BACKGROUND OF THE INVENTION

1. Field of the Invention

The present invention relates to a mobile, cryptographic round dater for use in mail operations. More particularly, the present invention relates to equipment and procedures associated with the mailing process whereby mailpieces and packages may be affixed with a cryptographic round date stamp that records mailing information in a unique data array.

2. Description of the Related Art

The Postal Service round dater has traditionally comprised a stamping device which, when applied to a mailpiece, leaves an ink mark on the mailpiece or package. The round date stamp typically shows information such as the date, time, and place of delivery of the mailpiece to the Postal Service. Round date stamps may be applied by means of a hand stamp. Additionally, round date stamps are also applied through a mechanical process whereby an impression-making device deposits ink on the mailpiece or package with the round date information.

Mail receptacles have occasionally been the targets of pranks, tampering, and vandalism. Recently, there have been more serious incidents involving contaminated mail. It is believed that mail was deposited and delivered through typical mail channels where the mailpieces had been deliberately contaminated with biological hazard material. Investigation has confirmed that some mailpieces deposited in mailboxes were contaminated with anthrax spores. Some members of the postal service, as a result of their handling contaminated mail, suffered exposure to the biological materials. Moreover, terrorists may attempt to use the mails to deliver harmful and dangerous agencies to a desired addressee.

In many instances the mailpiece or package that carries the terroristic or threatening agency is preserved. Thus the mailpiece itself becomes an important source of evidence for determining who may have perpetrated the illegal activity. Information on the package itself can be very useful in tracing the origins of the package. The information conveyed by the round dater stamp can provide very important information to investigators—the date and time the mailpiece was posted, and the place where the mailpiece entered postal processing.

Information can be added to the round date stamp that will help to prevent improper use of the US mail. In particular, the sender of a package or mailpiece can be required to submit identifying information that can be used to trace a mailpiece back to the individual who deposited it. Likewise, information can be recorded relating to the identity of the Postal Service employee who received a package from a customer.

Information that a package was received by a bona fide, authorized Postal Service employee can guard against fraudulent labeling, while at the same time discouraging collusion to subvert postal regulations between Postal employees and customers.

Thus it is desired to develop equipment and methods for using the same that provides a recordable link between the sender of a mailpiece and the mailpiece itself. It is also desired to develop a system of recording and printing mailer information that use existing hardware and software methods that are compatible with existing Postal Service processes. It is further desired to record mailer information using encryption technology where each mailing transaction is assigned a corresponding electronic signature.

It would also be desirable to retrofit existing machines so that they may access and apply the encrypted round dater, such as point of sale terminals, bulk mail acceptance systems, and mail processing equipment.

It would also be desirable to provide a method to improve security in postal processing that can be enacted quickly, easily and inexpensively.

SUMMARY OF THE INVENTION

The present invention overcomes deficiencies and shortcomings in current mail processing by providing a system for establishing a link between the person mailing a package or mailpiece and the mailpiece itself. In addition, by allowing a secure identification mark to be applied to a mailpiece and scanned and processed by a computer at any point in its processing, the present invention also provides a means for tracking the personnel who have handled a mailpiece, and the physical locations in which the mailpiece has been handled (such as point of entry, interim handling points, and delivery).

The system of the present invention includes a crypto round dater ("CRD"). The CRD records data that connects a given mailpiece with the customer who mails that piece, or at any point during the chain of custody of the Postal Service. Further, the identity of the Postal Service employee who date-stamps the mailpiece is recorded. This data recording creates a deterrent to those who might try to mail dangerous substances or otherwise use mails improperly, and helps prevent collusion of employees with those who wish to mail prohibited items.

The technology now exists to record even more information related to the origin of a mailpiece or package than what was heretofore shown on the Postal Service round date stamps. Two dimensional barcodes (2D barcodes) can record additional information such as the sender's name, address, and home ZIP code (5-digit or 9-digit). The 2D barcode can be affixed to a mailpiece or package by means of a packing label; alternatively it can be printed directly onto a mailpiece. The 2D barcode can also be combined with human-readable text that may resemble legacy round date stamps, providing both the convenience of high-density machine-readable data with the convenience of plain text information. Furthermore, the 2D barcode can provide a unique signature for the barcode label thus providing a high level of assurance that the barcode information is authentic and not counterfeit. Since the 2D barcode is not imminently human readable and may be encrypted, the privacy of the information stored may further be protected.

The act of providing such information when depositing a mailpiece or package can itself provide a significant deterrence against illegal or terroristic use of the mails. A postal customer who must provide information such as name, address, and return address, as well as identification to establish the validity of this information, will understand that the package he or she deposits in the mail can be traced back to the sender. Thus, for example, the use of a 2D barcode to record such information, coupled with the procedure of requesting this information from the mailer, will provide a deterrent against improper use of the mails.

The 2D barcode of the present invention can further be designed to thwart fraudulent use of the barcode or the CRD. For example, a unique signature may be encoded in each 2D barcode. The signature is transaction-unique. Further, the barcode may contain the serial number of the machine that issued the cryptographic round date stamp. The data encoded within the barcode indicates whether a round date stamp is bona fide, or whether a barcode printer has been used without authority. By containing secure authenticity information, the CRD stamp provides a means to guard against use of a cryptographic round date stamp that has been stolen or used without permission. Finally, by also linking an individual Postal Service employee to the intake transaction, the cryptographic round date stamps further protect against improper or unauthorized mailings.

An additional object of the present invention is to provide a method of routing customer data in a manner that may be electronically manipulated and processed in existing computer systems.

Further the use of an operator PIN and periodic replacement of the CRD will reduce the likelihood of unauthorized use of a CRD, and thus also deters any attempt to insert a dangerous substance into the mail stream.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims. It is to be understood that both the foregoing general description and the following detailed description are exemplary and explanatory only and are not restrictive of the invention, as claimed. Thus, the present invention comprises a combination of features, steps, and advantages which enable it to overcome various deficiencies of the prior art. The various characteristics described above, as well as other features, will be readily apparent to those skilled in the art upon reading the following detailed description of the preferred embodiments of the invention, and by referring to the accompanying drawings.

BRIEF DESCRIPTION OF THE DRAWINGS

For a more detailed description of a preferred embodiment of the present invention, reference will now be made to the accompanying drawings, which form a part of the specification, and wherein.

DETAILED DESCRIPTION OF THE PREFERRED EMBODIMENT

Reference will now be made in detail to exemplary embodiments of the invention, examples of which are illustrated in the accompanying drawings. Wherever possible, the same reference numbers will be used throughout the drawings to refer to the same or like parts.

There is provided a Cryptographic Round Dater, also known as a Crypto Round Dater or "CRD". The CRD will capture return address information such as street address, delivery point, ZIP Code, and customer name, in any human-readable and digital format. The CRD further will encrypt the customer information and transform it into the 2D barcode on the cryptographic clearance stamp, also known as the "crypto round date stamp."

An advantage of the CRD is the capability it provides to collect return address information or identification, and attach the mailer's identity to the particular mail piece. The crypto round date stamp may be printed directly onto the mailpiece or package as by a laser jet printer. Alternatively, a crypto round date stamp may be printed onto a label which is then applied to the package or mailpiece.

Figure 1:
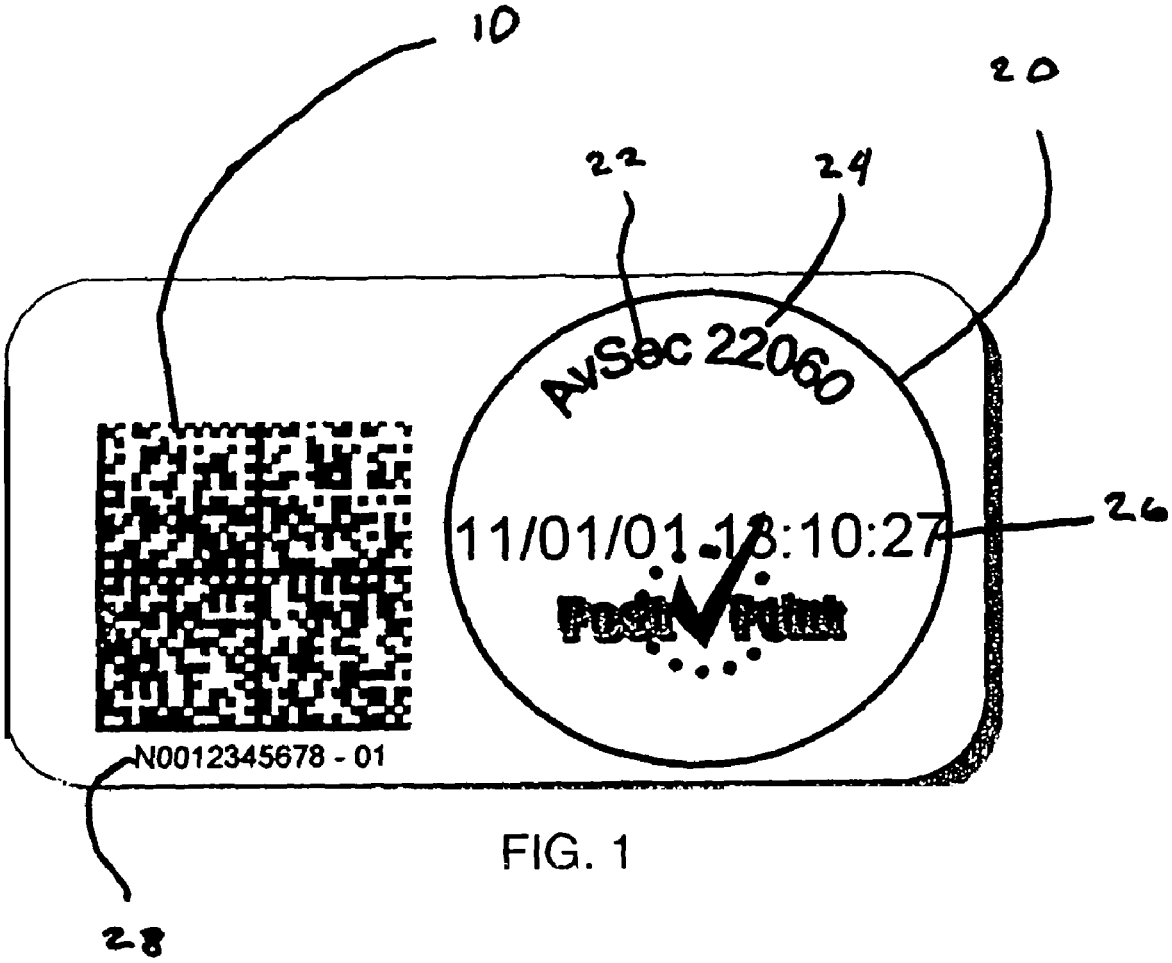
FIG. 1 displays a preferred format of the cryptographic crypto round date stamp.

The crypto round date stamp applied to a mailpiece will include several items of information. More particularly, the crypto round date stamp, as shown in FIG. 1 includes both a 2D barcode portion (10) and a point of receipt portion (20). The point of receipt portion of the crypto round date stamp provides human readable information related to the place where the mailpiece was received. The human readable information includes by way of example, the physical location of the Postal Service office (22), a ZIP code of that office (24), and a date and time indication (26) showing when the package or mailpiece was received by the Postal Service.

The crypto round date stamp used in the present invention also includes a machine readable 2D barcode portion (10). 2D barcode portion (10) also records information but in a machine readable format. Further, in a preferred embodiment, and as explained in more depth below, 2D barcode portion (10) records information in an encrypted format. Information that may be included in the 2D barcode portion of the crypto round date stamp includes, but is not limited to: the postage indicia algorithm identification, a certificate serial number, device identification, an ascending register, the date of mailing, the originating ZIP code, a software identification, a descending register, a digital signature, employee PIN number, time of receipt, return address and ZIP code, and a count number. Optionally, the crypto round date stamp may also display the Crypto Round Dater machine number (28) in human readable plaintext.

Figure 2:
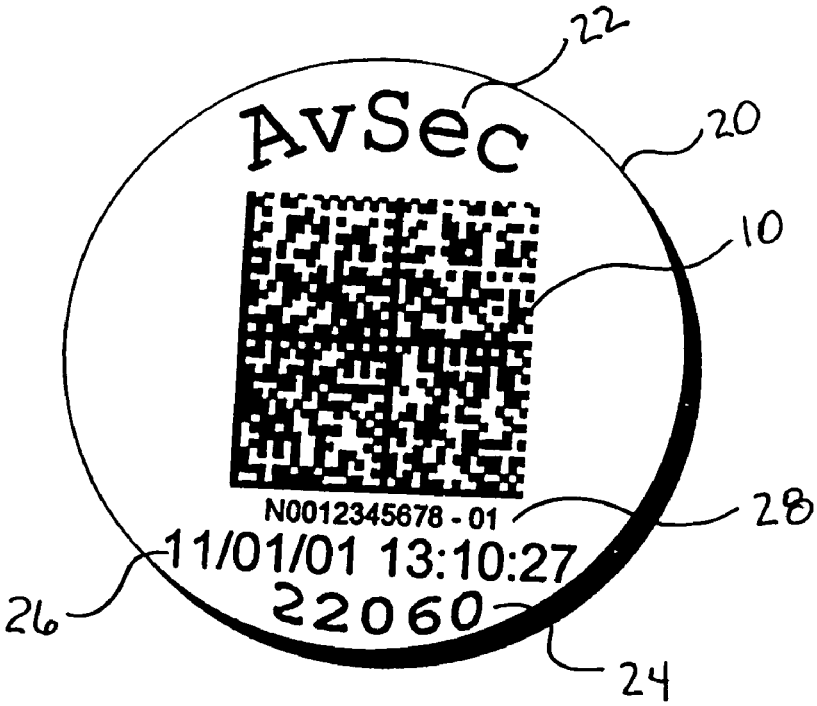
FIG. 2 displays an alternative preferred format of the cryptographic crypto round date stamp.
Figure 3:
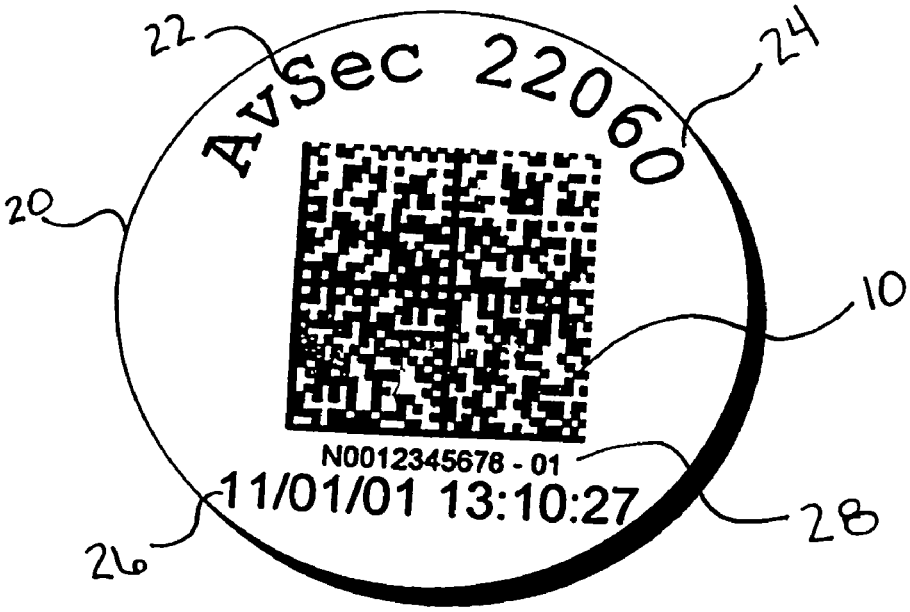
FIG. 3 displays an alternative preferred format of cryptographic crypto round date stamp.
Figure 4:
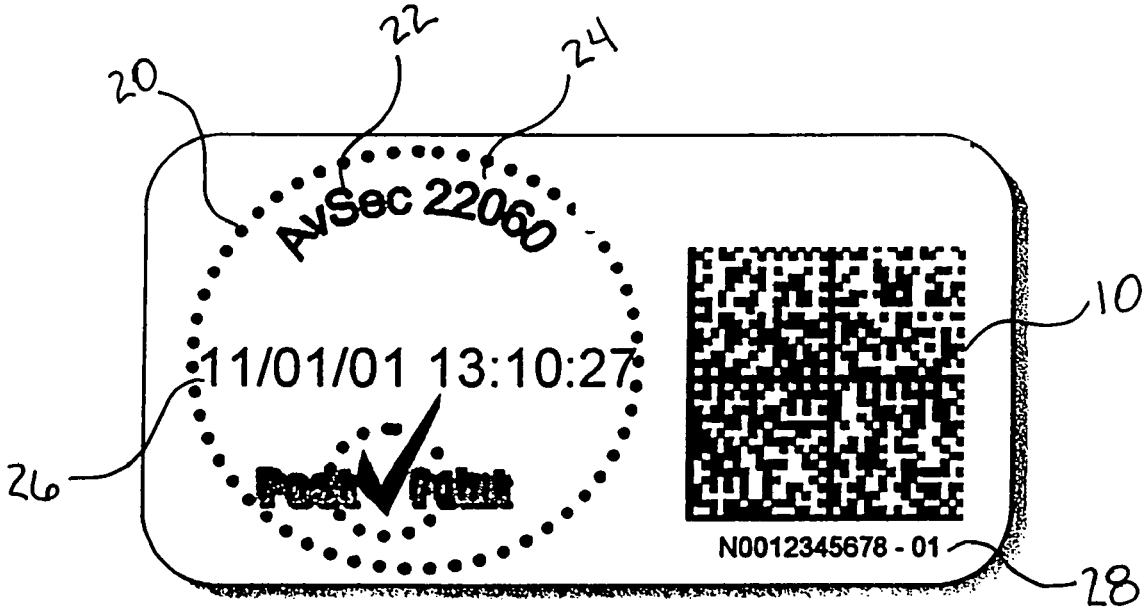
FIG. 4 displays an alternative preferred format of the cryptographic crypto round date stamp.

Those of skill in the art appreciate that the crypto round date stamp shown in FIG. 1 could be re-arranged into any number of different embodiments, including configurations where the point of receipt portion (20) is integrated with the 2D barcode (10). For example, FIG. 2, FIG. 3, and FIG. 4 provide alternate embodiments of the crypto round date stamp each illustrating a 2D barcode portion (10), a point of receipt portion (20), Postal Service office (22) and the ZIP code for that office (24), a received date and time indicator (26), and an optional Crypto Round Dater machine number. Optionally, a machine or human-readable mail classification such as "Registered," "Certified," "Insured," or other indicia could be displayed on an embodiment of the crypto round date stamp to assist in appropriately processing the mailpiece.

The encrypted round date stamp of the present invention will be facilitated by certain items of hardware and software. The crypto round date stamp or label is generated by a printing software application that receives inputted information and processes it into the desired output format. The data may be inputted using devices known in the prior art including, preferably, a personal computer. Alternatively, a networked computer terminal at a mail processing facility could be utilized to enter the customer and tracking information into the software application, and the networked computer terminal transmits data to a printer that produces the crypto round date stamp or label. Software applications that process information, and format data partially into a 2D barcode are also known in the art. For example, 2D barcodes are described by the National Institute of Standards and Technology. Standards for 2D barcodes have also been set by the Postal Service for use in generating postage indicia.

In a preferred embodiment the CRD is mobile. In an additional preferred embodiment, the CRD is mobile and hand held. A further feature of the invention is the use of hand held label readers and printers. The label reader and label printer read and print labels that include the 2D barcode as depicted in FIG. 1. A label reader includes a barcode scanner and a human-readable output. Thus, the reader can be used by Postal Service employees to access and review the content of a 2D barcode on a round dater label. The scanner includes those scanners known in the art to read 2D barcode. The output comprises an LCD display in alphanumeric format. The reader may have an optional means to transmit data from the 2D barcode into a computer or computer system, for example through a wireless means such as 802.11b WiFi, whereby the 2D barcode data may be further reviewed, processed, communicated and manipulated. The label printer includes the functionality for an alphanumeric import of 2D barcode data. Upon executing, the printer prints a round data label that includes both the 2D barcode and other human-readable information included in the round dater label. It will be appreciated that hand held readers and printers provide increased flexibility with respect to round dater labeling. Using hand held devices, USPS personnel can receive mailings, as well as monitor mailings, outside of a traditional Post Office.

2D barcode technology is now well understood. It is already used in other postal applications such as mailing labels, as shown for example in U.S. Pat. No. 6,428,219, which is incorporated herein by reference. Examples of 2D barcode include DataMatrix or PDF 417. The use of such barcodes in postal applications is further described in U.S. Pat. No. 6,463,354, incorporated herein by reference. For example PDF 417 is a two-dimensional stacked barcode symbology capable of encoding over a kilobyte of data per label.

The USPS has published a document which sets out the requirements and specifications for a computer system for use in mail handling operations that can receive, process, and print information including 2D barcode format. The document is PERFORMANCE CRITERIA FOR INFORMATION-BASED INDICIA AND SECURITY ARCHITECTURE FOR OPEN IBI POSTAGE METERING SYSTEMS, dated Apr. 26, 1999. This document is incorporated herein by reference. The 2D barcode specified in the Postal Service document can carry a significant amount of data in a manner that is machine-readable. The information can also be stored and processed electronically, which provides the further benefit that desired information may be gathered and collected, and reported, as necessary.

Figure 5:
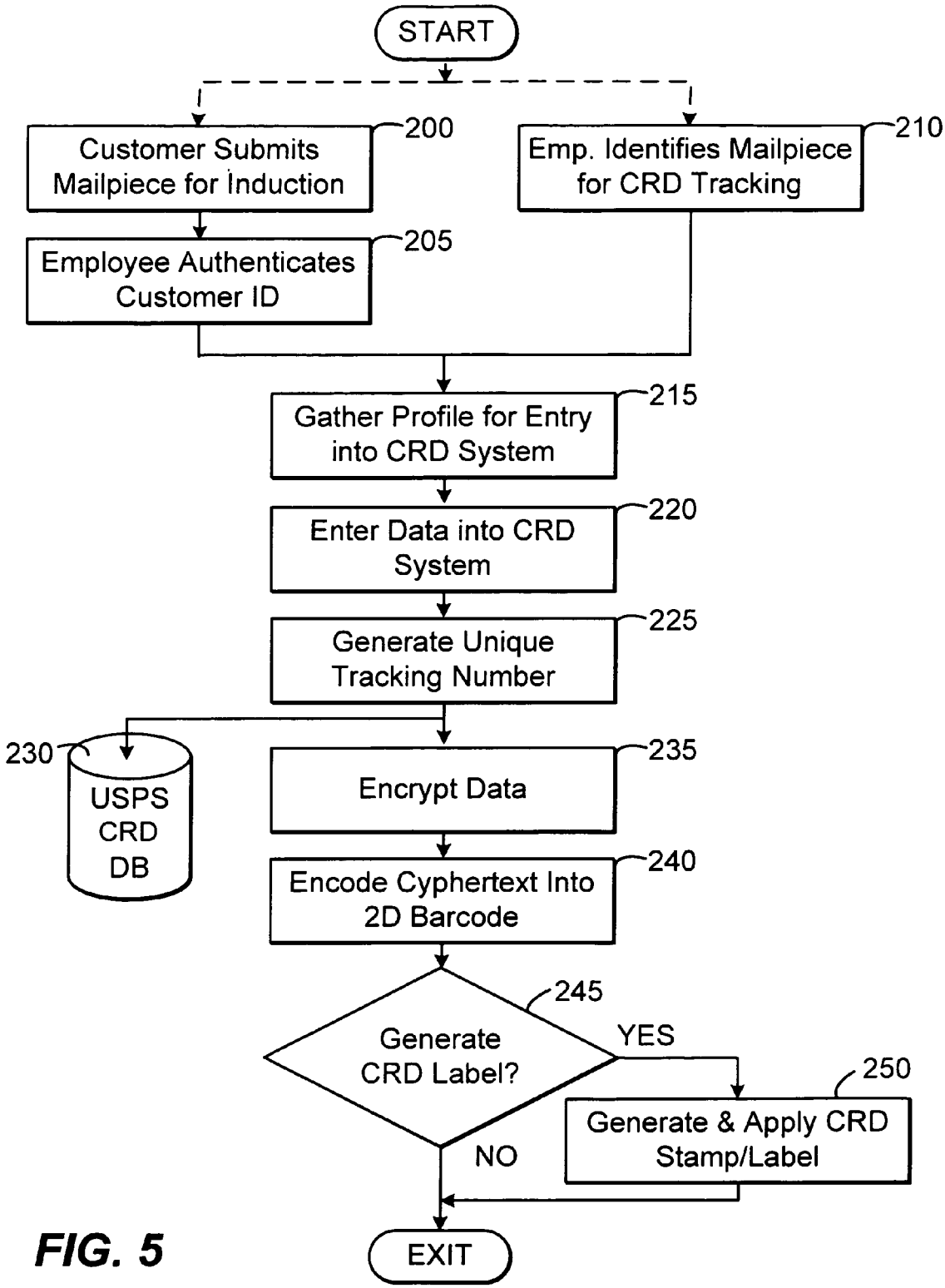
FIG. 5 illustrates a flow diagram for one method of using the Crypto Round Dater.

A method for using the CRD so as to deter improper use of the mails and provide package handling information includes the following steps as illustrated in the flow chart of FIG. 5. A mailpiece or package is presented to the Postal Service for shipment or induction by a customer (200), or in an alternate embodiment, a mailpiece may be chosen by a Postal Service employee for entry into the CRD system (210) without a direct customer submission. In one embodiment, the postal service employee that uses the CRD system must enter a valid PIN number before being able to enter data into the CRD.

If the mailpiece is being submitted by a customer (200), then the Postal Service employee has the opportunity to ask the customer to furnish a document showing proof of identification (205), such as a drivers license. This identification document may be used to verify information comprising a sender profile that is gathered by the Postal Service representative (215). The sender profile information may include, but is not limited to, any of the following: the customer's name, street address, city, state and ZIP code. The ZIP code comprises a five digit code but may also comprise a nine-digit ZIP code. During the customer authentication process, the Postal Service employee may compare the sender's profile to the return address information specified on the mailpiece, and further, the employee may verify the information on the identification document provided by the postal customer. In one embodiment, a customer's drivers license data is entered into a confirmation system through either manual data entry or scanning barcode information on the license, and the data is confirmed and/or verified with the appropriate state licensing authority, such as by sending a driver's license number or other indicia to the state licensing authority, and receiving information from the licensing authority that relates to the name, address, and other information that corresponds to the driver's license or indicia on file. In another embodiment, to reduce customer sensitivity to use of private information, the Postal Service employee could institute a verification by providing the customer's name and address to a state licensing authority, and receiving from the licensing authority a message or other indication that the provided customer name and address matches the current name and address information on file at the state licensing agency. If, in any case, the Postal Service employee is unable to sufficiently confirm the sender profile, the CRD system may record and process an indicia that the package is to be handled specially, e.g. with special handling for less than trusted mailpieces or mailpieces submitted under suspicious circumstances. Through this embodiment, for example, mailpieces associated with some level of suspicion could be affixed with crypto round date stamps indicating suspicion, causing routing to occur through ground transport rather than air transport, or requiring the mailpiece to be subjected to enhanced security screening procedures.

In an alternate embodiment, the sender profile information is not taken directly from customer input, but from information gathered by the Postal Service employee for any item in the mail stream, such as a mailpiece in transit, a mailpiece submitted from an alternate carrier, or a mailpiece submitted at a drop-off point.

After the Postal Service employee enters the sender profile information into the computer-based CRD system, the employee may add additional Postal Service information to be included in the 2D barcode, or the CRD system may add additional Postal Service information automatically (220). This information, related to the Postal Service, may include the employee identification of the Postal Service employee handling the mailing transaction, the receipt location of the USPS Office receiving the mailpiece (office name, location, and ZIP code), date and time the mailpiece was received, machine identification for the machine generating the Crypto Round Dater, software identification, and unique electronic signature.

Next in the process depicted in FIG. 5, the application software of the Crypto Round Dater generates a unique number to a given Crypto Round Dater labeling transaction (225). By assigning a unique signature, or tracking number, to a given transaction for a particular mailpiece, postal employees and inspectors can verify whether a crypto round date stamp's barcode is authentic or counterfeit. In one embodiment, the unique tracking number is also a registration number for the mailpiece, or alternatively, may be linked to a registration number for the mailpiece. Assignment of unique tracking numbers or signatures provides further deterrence against misuse of the CRD stamp, label, or mark, and prevents misuse of the Crypto Round Dater in particular. In one embodiment, these signatures or tracking numbers are also stored in a database (230) that is accessible by any employee who is authorized to use the CRD system. In another embodiment, the signatures or tracking numbers are only accessible by certain employees authorized to review and monitor the tracking process as facilitated by the CRD system. In yet another embodiment, all data entered into the CRD for a particular transaction is stored in the database (230) along with the signature or tracking information for that transaction.

Encryption technology is also known in the art. Examples of encryption software include Cryptographic Postage Validation Code (CPVC) and Postage Validation Code (PVC). Encryption of customer information provides several benefits. First it provides a level of anonymity and privacy that members of the public find beneficial. It further assists with postal security by precluding unauthorized personnel from accessing the information in the Crypto Round Dater. In a preferred embodiment as depicted in the flow chart of FIG. 5, selected information that is included in the 2D barcode is first encrypted (235) using an encryption software application prior to being encoded (240) into 2D barcode format. In one embodiment, selected information for encryption includes customer name, address, ZIP code, and employee identification. Other information may also be encrypted in alternative embodiments.

Continuing with the flow diagram of FIG. 5, upon approval by the Postal Service employee (245), a crypto round date stamp is generated for affixation to the mailpiece. The crypto round date stamp is then applied to the mailpiece (250), for example, by printing the crypto round date stamp directly onto the mailpiece or by printing the crypto round date stamp onto a label and applying the label to the mailpiece. Those of skill in the art also may recognize that in one embodiment of the present invention, the crypto round date stamp could be incorporated into a mailpiece label at the Point of Sale (POS) terminal. Such mailpiece labels may comprise Express Mail® labels, Priority Mail® labels, Registered Mail labels, or any other type of mail-classification labels commonly affixed to mailpieces. By incorporating the crypto round date stamp with the legacy mailpiece labels, efficiency is promoted and security is enhanced by tying together postage, delivery, and security tracking information.

In operation, the CRD can be used to record mailer information in any transaction where such information is provided. Advantageously, the CRD can be used to record mailer information that has been confirmed when the mail transaction occurs in a face to face setting. In this manner the Postal Service employee can confirm the mailer's identity and return address information by asking for a proper form of identification. Also as described above, in another embodiment, the CRD label can be generated by an authorized employee during any phase of a mailpieces' handling, enabling a particular mailpiece to be tracked by the locations through which it traveled and the employees that handled the mail. If necessary, more than one CRD stamp or label may be applied to a mailpiece, each containing similar or diverse information to enable the collection and analysis of more detailed tracking information. Through adding additional data or crypto round date stamps not originated by a customer submitting a mailpiece for induction, for example, it is possible to more accurately determine which mail facilities or postal employees may have been exposed to a potential hazardous substance such as weaponized anthrax spores. Likewise, with the more accurate information provided by the crypto round date stamp, management can take directed action to more effectively mitigate potential harm to employees and the public, and to assist in apprehending the perpetrator.

While preferred embodiments of this invention have been shown and described, modifications thereof can be made by one skilled in the art without departing from the spirit or teaching of this invention. The embodiments described herein are exemplary only and are not limiting. Many variations and modifications of the system and apparatus are possible and are within the scope of the invention. One of ordinary skill in the art will recognize that the process just described may easily have steps added, taken away, or modified without departing from the principles of the present invention. Accordingly, the scope of protection is not limited to the embodiments described herein, but is only limited by the claims which follow, the scope of which shall include all equivalents of the subject matter of the claims.

What is claimed is:

1. A computer-implemented method of enhancing shipping security of a postal service associated with the receipt from a sender of a piece for shipping, the method comprising:

confirming an identification of the sender of the piece;

utilizing a computer, producing and affixing to the piece a crypto round date stamp containing a post office physical location and zip code in human readable form where the piece was received;

utilizing the computer, producing and affixing to the piece encryption indicia located within the crypto round data stamp, wherein the encryption indicia comprises a two-dimensional barcode, the encryption indicia including:

an identification of the sender;

the location where the piece was received;

an employee identification number of an employee of the postal service who received the piece from the sender;

an identification of a generator generating a two-dimensional barcode;

the time that the piece was received from the sender;

utilizing the computer, authenticating the human readable information contained in the crypto round date stamp with information included in the two-dimensional barcode;

utilizing the computer, scanning the crypto round date stamp for the employee identification number of the employee of the postal service who received the piece from the sender and detecting collusion by the employee; and utilizing the computer, preventing the collusion using the employee identification number.

2. The computer-implemented method as defined in claim 1, wherein confirming comprises confirming the identification of the sender with a government licensing authority.

3. The computer-implemented method as defined in claim 1, wherein confirming comprises comparing the name and address of the sender with information received from a government.

4. The computer-implemented method as defined in claim 1, wherein the confirming step comprises:

submitting the name and address of the sender to a government licensing authority; and receiving from the government licensing authority information regarding whether the name and address of the sender is confirmed with the government licensing authority.

5. The computer-implemented method as defined in claim 1, wherein the identification of the sender of the piece comprises a name and address of the sender.

6. The computer-implemented method as defined in claim 1, further comprising, prior to the affixing, confirming an identity of a receiver receiving the piece from the sender.

7. The computer-implemented method as defined in claim 6, wherein the confirming of the identity of the receiver comprises receiving and verifying a personal identification code for the receiver.

8. The computer-implemented method as defined in claim 1, wherein the encryption indicia comprises a postage indicia algorithm identification.

* * * * *